US007644774B2

(12) United States Patent
Branch et al.

(10) Patent No.: US 7,644,774 B2
(45) Date of Patent: Jan. 12, 2010

(54) SELECTIVELY ACTIVATED FLOAT EQUIPMENT

(75) Inventors: Alton Branch, Comanche, OK (US); Donny Winslow, Duncan, OK (US); Aimee Greening, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 12/400,320

(22) Filed: Mar. 9, 2009

(65) Prior Publication Data

US 2009/0166044 A1 Jul. 2, 2009

Related U.S. Application Data

(62) Division of application No. 11/348,909, filed on Feb. 7, 2006, now Pat. No. 7,527,104.

(51) Int. Cl.
*E21B 34/10* (2006.01)

(52) U.S. Cl. ..... 166/386; 166/232; 166/327

(58) Field of Classification Search ..... 166/386, 166/323, 327

See application file for complete search history.

(56) References Cited

U.S. PATENT DOCUMENTS

| | | | |
|---|---|---|---|
| 2,373,647 | A | 4/1945 | Boynton |
| 2,627,316 | A | 2/1953 | Baker |
| 2,644,481 | A | 4/1953 | Perlman |
| 2,751,021 | A | 6/1956 | Muse |
| 2,874,785 | A | 2/1959 | Muse |
| 3,051,246 | A | 8/1962 | Clark |
| 3,129,764 | A | 4/1964 | Stein |
| 3,409,078 | A | 11/1968 | Knox et al. |
| 3,419,081 | A | 12/1968 | Nelson |
| 3,571,936 | A | 3/1971 | Taylor |
| 3,776,250 | A | 12/1973 | Knox |
| 4,067,358 | A | 1/1978 | Streich |
| 4,474,241 | A | 10/1984 | Freeman |
| 4,712,619 | A | 12/1987 | Stepp et al. |
| 4,729,432 | A | 3/1988 | Helms |
| 5,320,181 | A | 6/1994 | Lantier et al. |

(Continued)

FOREIGN PATENT DOCUMENTS

| | | |
|---|---|---|
| GB | 2391239 | 2/2004 |

(Continued)

OTHER PUBLICATIONS

Foreign communication related to a counterpart application dated May 11, 2007.

(Continued)

*Primary Examiner*—Shane Bomar
(74) *Attorney, Agent, or Firm*—John W. Wustenberg; Baker Botts, LLP

(57) ABSTRACT

A valve for a well pipe, the valve having the following parts: a valve collar connectable to the well pipe; an index piston coaxially positioned within the valve collar for longitudinal translation within the valve collar between closed, flow-open, and locked-open configurations; a detent in the index piston, wherein the detent restricts fluid flow in a circulation direction through a flow path through the index piston; a spring that biases the index piston toward the closed and locked-open configurations; and a plug of the valve collar that mechanically communicates with the index piston to be in corresponding closed, flow-open, and locked-open configurations.

5 Claims, 7 Drawing Sheets

U.S. PATENT DOCUMENTS

| | | | | |
|---|---|---|---|---|
| 5,377,762 | A | | 1/1995 | Turner |
| 5,456,322 | A | | 10/1995 | Tucker et al. |
| 5,494,107 | A | * | 2/1996 | Bode ..... 166/285 |
| 5,722,491 | A | | 3/1998 | Sullaway et al. |
| 5,803,177 | A | | 9/1998 | Hriscu et al. |
| 5,829,526 | A | | 11/1998 | Rogers et al. |
| 6,047,949 | A | | 4/2000 | Beauchemin et al. |
| 6,102,060 | A | | 8/2000 | Howlett et al. |
| 6,109,354 | A | | 8/2000 | Ringgenberg |
| 6,244,342 | B1 | | 6/2001 | Sullaway et al. |
| 6,497,291 | B1 | | 12/2002 | Szarka |
| 6,513,598 | B2 | | 2/2003 | Moore et al. |
| 6,622,795 | B2 | | 9/2003 | Hebert et al. |
| 6,725,935 | B2 | | 4/2004 | Szarka et al. |
| 6,810,958 | B2 | | 11/2004 | Szarka et al. |
| 6,820,695 | B2 | | 11/2004 | Stevens et al. |
| 2005/0173119 | A1 | | 8/2005 | Hay et al. |
| 2007/0181188 | A1 | | 8/2007 | Branch et al. |
| 2007/0187107 | A1 | | 8/2007 | Pringle |

FOREIGN PATENT DOCUMENTS

| | | |
|---|---|---|
| WO | 2005/098197 | 10/2005 |
| WO | 2007/091055 | 8/2007 |

OTHER PUBLICATIONS

Office Action from U.S. Appl. No. 11/348,909 dated Jan. 29, 2009.
Office Action from U.S. Appl. No. 11/348,909 dated Oct. 7, 2008.
Office Action from U.S. Appl. No. 11/348,909 dated Mar. 18, 2008.

* cited by examiner

SELECTIVELY ACTIVATED FLOAT EQUIPMENT

CROSS-REFERENCE TO RELATED APPLICATIONS

This application is a divisional of application Ser. No. 11/348,909, filed Feb. 7, 2006 U.S. Pat. No. 7,527,104, entitled "Selectively Activated Float Equipment," which issued May 5, 2009, the entirety of which is incorporated herein by reference.

BACKGROUND

The present invention relates generally to fluid control valves for production well equipment. In particular, this invention relates to back pressure valves for reverse cementing applications.

Production wells typically have valves and valve seats also known as check valves and back pressure valves. These valves are utilized in different applications in various industries including but not limited to the oil and gas industry. Current back pressure valves supply a one direction flow and a negative flow from the other direction. This may be desirable when a controlled flow is important for such purposes as safety well control while placing a casing string and/or tubing in a potentially active well.

Typical valves may be mechanically manipulated to selectively change the direction of flow during operations and then selectively change the flow direction back to an original direction. Valves are usually manipulated between configurations by mechanical movement of the casing/tubing, or placing an inter string inside the casing/tubing string to apply weight on the valve so as to hold the valve in an open configuration. Other mechanisms for manipulating valves include disabling the valve with a pressure activated ball or plug allowing flow to enter the casing/tubing string. But these valves cannot be reactivated, if desired. Other valves are manipulated when the casing bottoms in the rat hole at the bottom of the well bore so that the valve is mechanically held open by the set down weight.

SUMMARY OF THE INVENTION

The present invention relates generally to fluid control valves for production well equipment. In particular, this invention relates to back pressure valves for reverse cementing applications.

More specifically, one embodiment of the present invention is directed to a valve for a well pipe, the valve having the following parts: a valve collar connectable to the well pipe; an index piston coaxially positioned within the valve collar for longitudinal translation within the valve collar between closed, flow-open, and locked-open configurations; a detent in the index piston, wherein the detent restricts fluid flow in a circulation direction through a flow path through the index piston; a spring that biases the index piston toward the closed and locked-open configurations; and a plug of the valve collar that mechanically communicates with the index piston to be in corresponding closed, flow-open, and locked-open configurations.

According to a further aspect of the invention, there is provided a valve for a well pipe, the valve being made up of different components including: a valve collar connectable to the well pipe, wherein the valve collar comprises an indexing lug; an index piston coaxially positioned within the valve collar for longitudinal translation within the valve collar between closed, flow-open, and locked-open configurations, wherein the index piston comprises an index pattern comprising closed, flow-open, and locked-open positions such that when the indexing lug is positioned at the closed, flow-open, and locked-open positions, the index piston is configured in the closed, flow-open, and locked-open configurations, respectively; a detent in the index piston, wherein the detent restricts fluid flow in a circulation direction through a flow path through the index piston; a spring that biases the index piston toward the closed and locked-open configurations; and a plug of the valve collar that mechanically communicates with the index piston to be in corresponding closed, flow-open, and locked-open configurations.

Another aspect of the invention provides a method of regulating fluid circulation through a well casing, the method having the following steps: attaching a valve to the casing; running the valve and casing into the well, wherein the valve is in a closed configuration to maintain relatively higher fluid pressure outside the casing compared to the fluid pressure in the inner diameter of the casing; circulating fluid down the inner diameter of the casing and through the valve to the outside of the casing, wherein the valve is manipulated by the fluid circulation to an open configuration; and ceasing the circulating fluid, wherein the valve is manipulated to a locked-open configuration.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings.

DETAILED DESCRIPTION OF THE EMBODIMENTS

The present invention relates generally to fluid control valves for production well equipment. In particular, this invention relates to back pressure valves for reverse cementing applications. The details of the present invention will now be described with reference to the accompanying drawings. This specification discloses various valve embodiments.

Figure 1A:
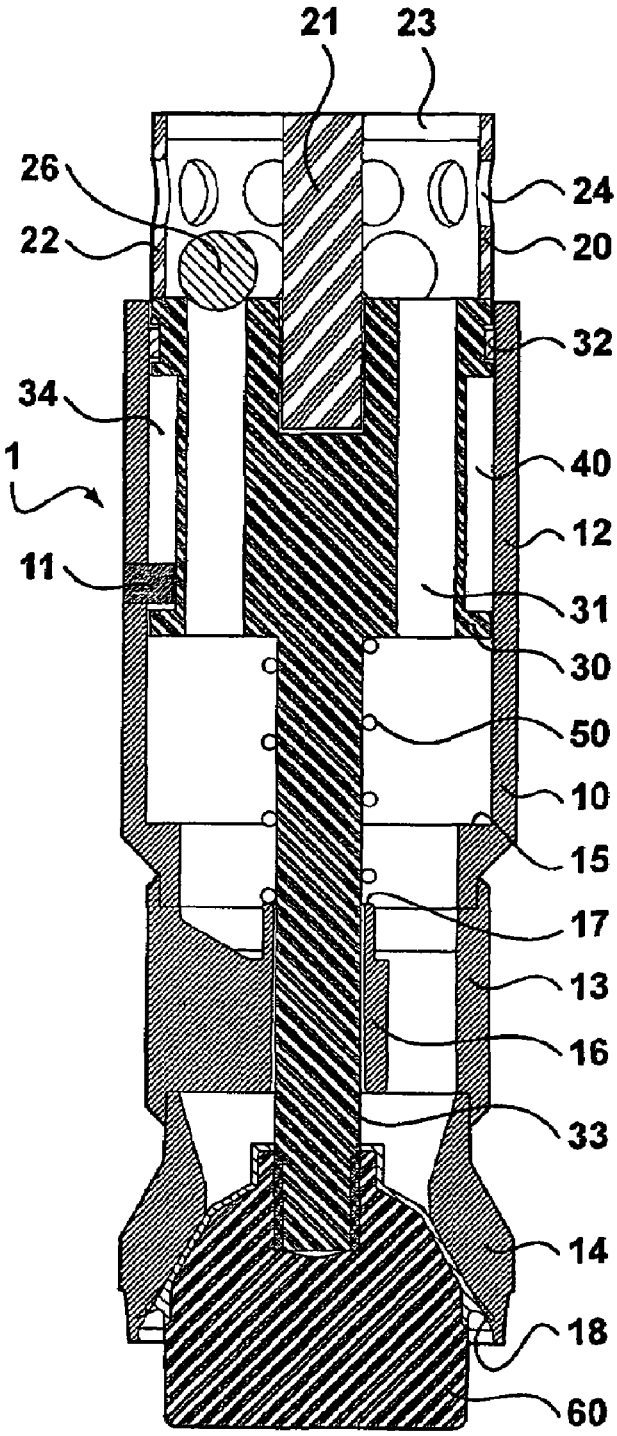
FIG. 1A is a cross-sectional side view of an embodiment of a valve of the present invention, wherein the valve is shown in a closed configuration.
Figure 1B:
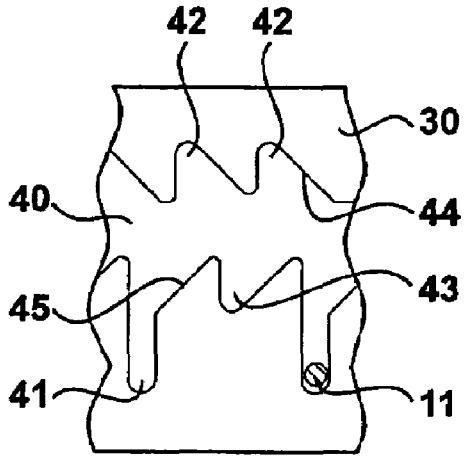
FIG. 1B is a schematic side view of an embodiment of an index pattern and indexing lug, wherein the indexing lug is located in a closed position.
Figure 2A:
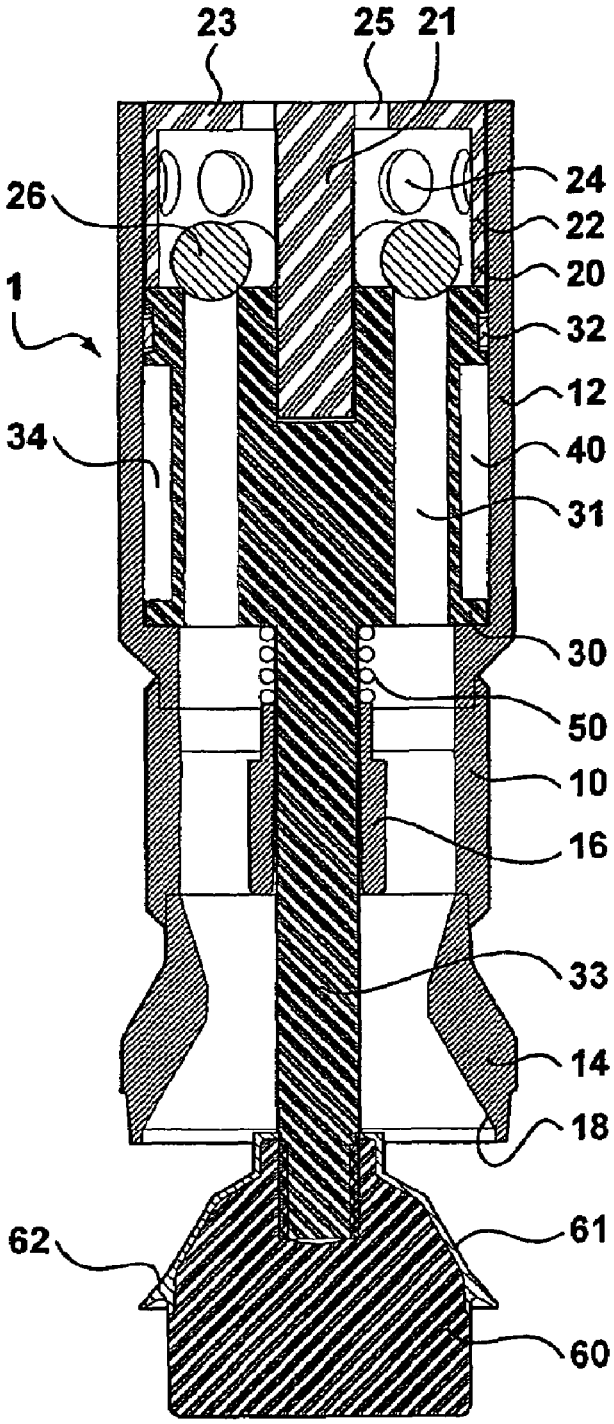
FIG. 2A is a cross-sectional side view of the valve of FIG. 1A, wherein the valve is shown in a flow-open configuration.
Figure 2B:
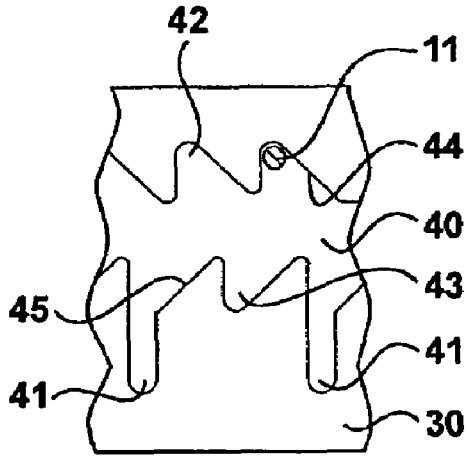
FIG. 2B is a schematic side view of the index pattern and indexing lug of FIG. 1B, wherein the indexing lug is located in a flow-open position.
Figure 3A:
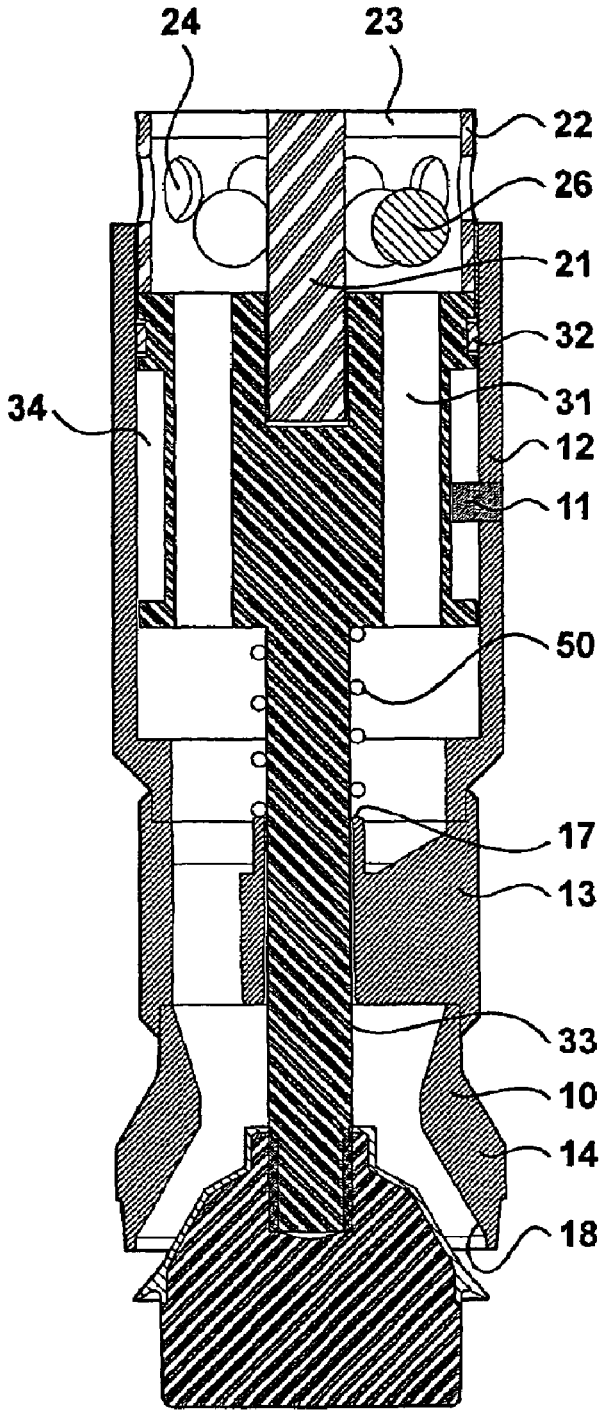
FIG. 3A is a cross-sectional side view of the valve of FIGS. 1A and 2A, wherein the valve is shown in a locked-open configuration.
Figure 3B:
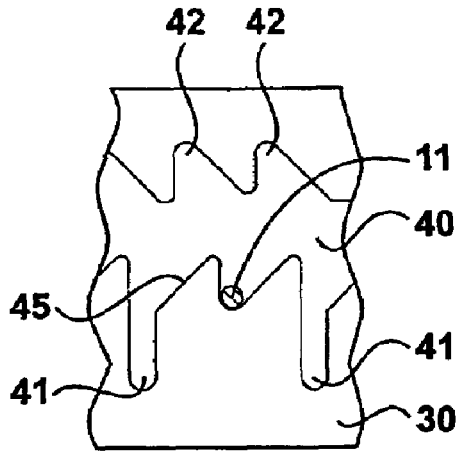
FIG. 3B is a schematic side view of the index pattern and indexing lug of FIGS. 1B and 2B, wherein the indexing lug is located in a locked-open position.

Referring to FIGS. 1A, 2A, and 3A, cross-sectional side views of a valve 1 are illustrated. The valve 1 has several major components including: a valve collar 10, a detent in the form of a ball cage 20, an index piston 30, an index pattern 40, a spring 50, and a poppet plug 60. FIGS. 2A and 3A also illustrate cross-sectional side views of the valve 1. In FIG. 1A, the valve 1 is shown in a closed position. In FIG. 2A, the valve 1 is shown in a flow-open position. In FIG. 3A, the valve 1 is shown in a locked-open position. FIGS. 1B, 2B, and 3B illustrate schematic side views of the index pattern 40. In each of these figures, an indexing lug 11 is shown in a different position as described more fully below.

Referring to FIGS. 1A, 2A, and 3A, each of the major components of the valve 1 are described. The valve collar 10 is a cylindrical structure that houses the other major components. The valve collar 10 has three sections, including: the indexing section 12, the mounting section 13, and the seat section 14. The mounting section 13 has female threads at its upper and lower ends, wherein male threads of the indexing section 12 are made up to the upper end of the mounting section 13 and male threads of the seat section 14 are made up to the lower end of the mounting section 13. The indexing section 12 has a shoulder 15 wherein the inside diameter of the indexing section 12 is smaller below the shoulder as compared to above the shoulder 15. The mounting section 13 has a stem mount 16 that extends from the inside diameter side wall of the mounting section 13. The stem mount 16 is an arm having an annular eyelet at its distal end for receiving a stem 33 of the index piston 30. The seat section 14 has a beveled valve seat 18 for receiving the poppet plug 60.

The ball cage 20 is a somewhat umbrella-shaped structure mounted to the top of the index piston 30 that serves as a ball valve type of detent. The ball cage 20 has a support shaft 21 that extends along the longitudinal central axis of the ball cage 20. The ball cage 20 also has a cylindrical strainer section 22 that has an outside diameter slightly smaller than the inside diameter of the indexing section 12 of the valve collar 10. The strainer section 22 is mounted to the support shaft 21 via a top plate 23. The strainer section 22 has a plurality of side holes 24 that allow fluid communication through the strainer section 22. The top plate 23 also has a plurality of top holes 25 that also allow fluid communication through the ball cage 20. The ball cage 20 is connected to the index piston 30 via the support shaft 21, which extends into a recess in the top of the index piston 30. The support shaft 21 is threaded, welded, or otherwise connected to the index piston 30. The lower edge of the strainer section 22 sits on the top of the index piston 30 and may also be connected thereto. The ball cage 20 also comprises a plurality of balls 26, which are freely allowed to move about within the ball cage 20. The outside diameter of the balls 26 are larger than the inside diameter of the side holes 24 and top holes 25 so that the balls 26 are retained within the ball cage 20.

The index piston 30 has a plurality of flow ports 31 that extend through the index piston 30 parallel to the longitudinal central axis of the piston 30. The inside diameter of the flow ports 31 are smaller than the outside diameter of the balls 26 of the ball cage 20. An annular seal 32 is positioned in a recessed near the top of the outside circumference of the index piston 30 to form a seal between the index piston 30 and the valve collar 10. The annular seal 32 restricts fluid flow between the two structures even as the index piston 30 translates longitudinally within the valve collar 10. The indexing piston 30 also has an indexing J-Slot 34 in its exterior wall. The indexing J-Slot 34 has an index pattern 40 described in more detail below. The stem 33 extends from the bottom of the index piston 30 so as to connect the poppet plug 60 to the index piston 30 through the stem mount 16. The poppet plug 60 is threaded, welded, molded, or otherwise fastened or connected to the end of the stem 33.

As shown in FIGS. 1A, 2A, and 3A, the spring 50 is positioned concentrically around the stem 33 of the index piston 30. At its upper end, the spring engages the lower face of the index piston 30 and at its lower end, the spring 50 engages a spring shoulder 17 at the upper edge of the stem mount 16. In FIG. 1A, the spring 50 is illustrated in a relaxed or expanded position, while in FIG. 2A, the spring 50 is completely compressed. In FIG. 3A, the spring 50 is only partially compressed.

The poppet plug 60 is connected to a lower most end of the stem 33 for longitudinal movement into and out of engagement with the valve seat 18 of the seat section 14. The poppet plug 60 has a conical seal surface 61 for engagement with the valve seat 18. The seal surface 61 terminates in a seal lip 62 that deflects slightly when the poppet plug 60 is inserted into the valve seat 18. The deflection of the seal lip 62 ensures the integrity of the seal when the valve is closed.

Referring to FIGS. 1B, 2B, and 3B, the index pattern 40 defines several lug positions that are used to configure the valve in closed, flow-open, and locked-open positions. Closed positions 41 are located in the lower-most portions of the index pattern 40. When the indexing lug 11 is located in one of the closed positions 41, the valve 1 is configured in a closed configuration. Flow-open positions 42 are found in the upper-most portions of the index pattern 40. As shown in FIG. 2B, when the indexing lug 11 is positioned in one of the flow-open positions 42, the valve 1 is configured in a flow-open configuration. Locked-open positions 43 are found in a medium lower position of the index pattern 40. When the indexing lug 11 is in a locked-open position 43, the valve 1 is in a locked-open configuration. FIG. 3B illustrates the indexing lug 11 in a locked-open position 43 which corresponds to a valve 1 configuration that is locked-open as illustrated in FIG. 3A. FIG. 1B illustrates the indexing lug 11 in a closed position 41, which corresponds to a closed valve 1 configuration as illustrated in FIG. 1A. FIG. 2B illustrates the indexing lug 11 in a flow-open position 42 which corresponds to a valve flow-open configuration as illustrated in FIG. 2A.

Figure 4:
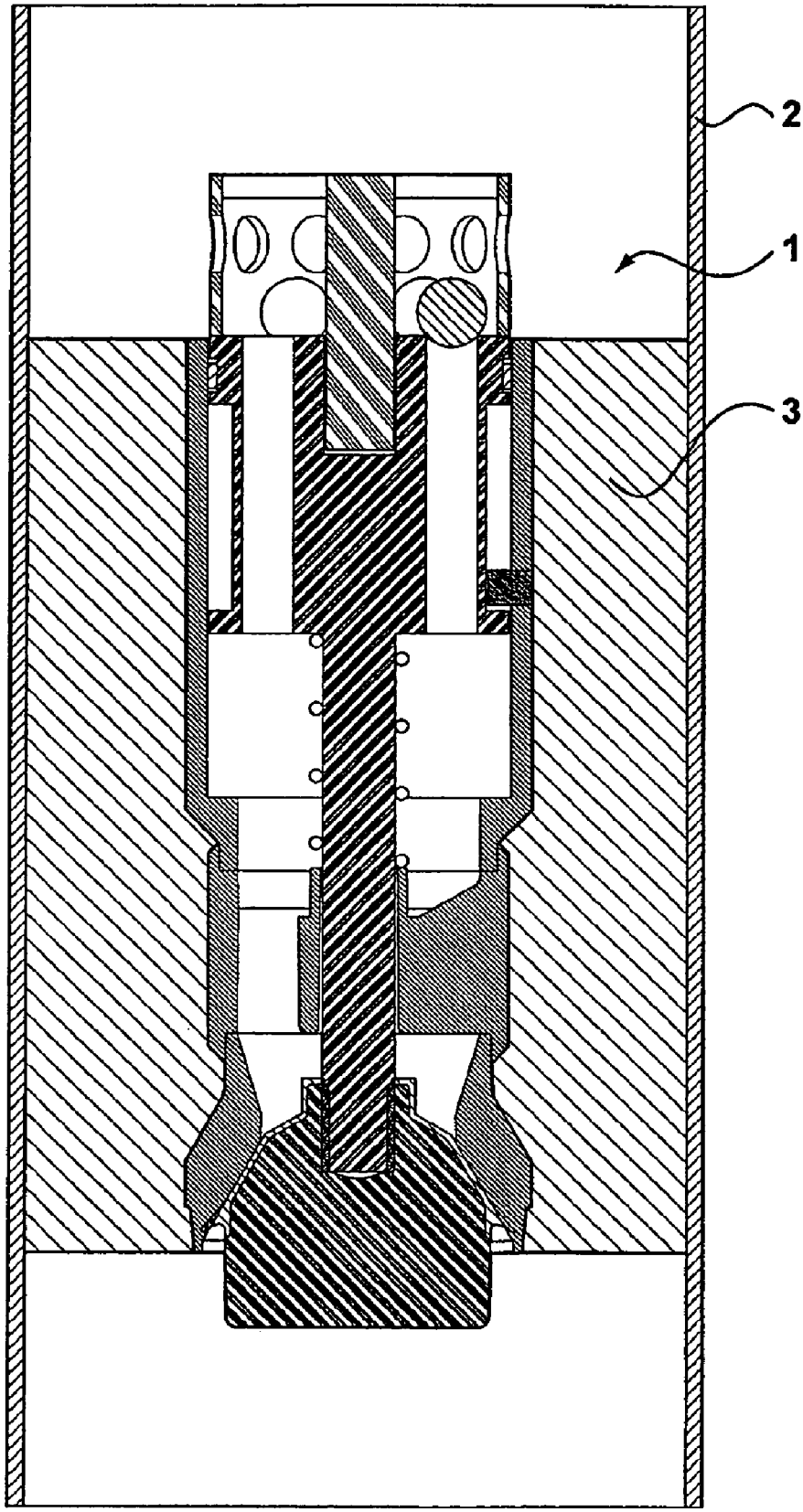
FIG. 4 is a cross-sectional side view of an embodiment of a valve of the present invention fixed in a casing by a cement attachment.

FIG. 4 illustrates a valve 1 of the present invention assembled into a casing 2. The annular space between the valve collar 10 of the valve 1 and the casing 2 may be filled with a concrete or cement attachment 3 to allow the valve 1 to be drilled out of the casing should removal of the valve 1 become necessary. In other embodiments of the invention, the valve 1 may be connected to the casing 2 by any means known to persons of skill. For example, the valve 2 may be stung into a casing collar, or threaded into an internal casing flange.

The process for operating the valve is described with reference to FIGS. 1A, 2A, and 3A. When the valve is run into the well, the valve 1 is in the closed configuration with the spring 50 holding the valve 1 closed. In the illustrated embodiment, the spring 50 is compressed between the bottom face of the index piston 30 and the spring shoulder 17. The force of the spring 50 biases the poppet plug 60 toward the valve seat 18. In particular, the valve 1 is biased to a closed configuration. With the valve 1 in the closed configuration, the indexing lug 11 is located in a closed position 41 as shown in FIG. 1B. As the casing 2 and valve 1 are run into the well, increasing fluid pressure from below the valve 1 is checked against the poppet plug 60 and is not allowed to enter the inner diameter of the casing 2.

When it is desired to open the valve 1, fluid may be circulated down the inner diameter of the casing 2 to the valve 1. Due to gravity, fluid moving in the circulation direction, or any other forces in play, the balls 26 within the ball cage 20 seat themselves in the tops of some of the flow ports 31 (see FIGS. 1A and 2A). The circulating fluid then flows through the remaining open flow port(s) 31. However, for fluid to flow through the valve 1, the fluid pressure inside the inner diameter of the casing 2 must increase to overcome the fluid pressure outside the valve 1 and to overcome the bias force applied by the spring 50. When the fluid pressure becomes large enough, the poppet plug 60 unseats from the valve seat 18 to allow fluid to circulate through the valve. The valve 1 becomes partially open.

As fluid is circulated through the valve 1, the remaining open flow port(s) 31 present a relatively restricted cross-sectional flow area, a pressure differential is created across the valve 1. As the flow rate increases, the pressure differential increases. When the pressure differential becomes great enough to overcome the bias force of the spring 50, the valve 1 is reconfigured to the flow-open configuration (see FIG. 2A). In this configuration, the valve 1 is completely open and the indexing lug 11 is driven to a flow-open position 42 in the index pattern 40.

The relative movement of the indexing lug 11 and the index pattern 40, as the valve 1 moves from the closed configuration to the flow-open configuration, is described with reference to FIGS. 1B and 2B. As the poppet plug 60 moves out of the valve seat 18, the index piston 30 translates downwardly relative to the valve collar 10 and the indexing lug 11. This relative movement corresponds to the indexing lug 11 moving upward in the index pattern from a closed position 41 to a flow-open position 42 (see FIGS. 1B and 2B). As the indexing lug 11 approaches the flow-open position 42, the indexing lug 11 contacts and slides along an upper ramp 44. As the indexing lug 11 slides along the upper ramp 44, the index piston, ball cage 20 and poppet plug 60 rotate and translate relative to the valve collar 10. As long as fluid continues to circulate at a sufficient flow rate through the remaining open flow port(s) 31 from the inside diameter of the casing 2 to the exterior of the casing 2, the indexing lug 11 is driven to the flow-open position 42. Simultaneously, the spring 50 collapses and the indexing J-slot 34 moves across the indexing lug 11 so as to position the indexing lug 11 in the flow-open position 42 of the index pattern 40 (see FIGS. 1B and 2B).

Fluid flow in the circulation direction through the valve 1 may be continued as long as desired to circulate the well. When flow in the circulation direction is discontinued (pumping stops), the pressure equalizes across the flow ports 31 allowing the spring 50 to push the poppet plug 60 upwards. This upward movement of the poppet plug 60, stem 33, and index piston 30 will index the indexing J Slot 34 to either the closed position 41 or the locked-open position 43. The index pattern 40 has alternating closed positions 41 and locked-open positions 43. Thus, each time flow in the circulation direction is continued and discontinued, the valve 1 will alternate between a closed configuration and a locked-open configuration. Because the index pattern 40 repeats itself indefinitely in circular fashion, there is no limit to the number of times the valve 1 may opened and closed.

The relative movement of the indexing lug 11 and the index pattern 40, as the valve 1 moves from the flow-open configuration to the locked-open configuration, is described with reference to FIGS. 2B and 3B. When fluid flow in the circulation direction is discontinued, the valve 1 is no longed held in the flow-open configuration. The spring 50 pushes the index piston 30 upwardly relative to the valve collar 10 and the indexing lug 11. This relative movement corresponds to the indexing lug 11 moving downward in the index pattern 40 from a flow-open position 42 to a locked-open position 43 (see FIGS. 2B and 3B). As the indexing lug 11 approaches the locked-open position 43, the indexing lug 11 contacts and slides along a lower ramp 45. As the indexing lug 11 slides along the lower ramp 45, the index piston 30, ball cage 20 and poppet plug 60 rotate and translate relative to the valve collar 10. The spring 50 expands to drive the indexing lug 11 to the locked-open position 43. Simultaneously, the spring 50 expands and the indexing J-slot 34 moves across the indexing lug 11 so as to position the indexing lug 11 in the locked-open position 43 of the index pattern 40 (see FIGS. 2B and 3B).

If the valve 1 had previously been in the locked-open configuration immediately before fluid flow in the circulation direction is started and stopped, the valve will then cycle to a closed configuration. The relative movement of the indexing lug 11 and the index pattern 40, as the valve 1 moves from the flow-open configuration to the closed configuration, is described with reference to FIGS. 2B and 1B. When fluid flow in the circulation direction is discontinued, the valve 1 is no longed held in the flow-open configuration. The spring 50 pushes the index piston 30 upwardly relative to the valve collar 10 and the indexing lug 11. This relative movement corresponds to the indexing lug 11 moving downward in the index pattern 40 from a flow-open position 42 to a closed position 41 (see FIGS. 2B and 1B). As the indexing lug 11 approaches the closed position 41, the indexing lug 11 contacts and slides along a lower ramp 45. As the indexing lug 11 slides along the lower ramp 45, the index piston 30, ball cage 20 and poppet plug 60 rotate and translate relative to the valve collar 10. The spring 50 expands to drive the indexing lug 11 to the closed position 41. Simultaneously, the spring 50 expands and the indexing J-slot 34 moves across the indexing lug 11 so as to position the indexing lug 11 in the closed position 41 of the index pattern 40 (see FIGS. 2B and 1B).

In certain embodiments of the invention, the valve 1 may be cycled between closed, flow-open and locked-open configurations an unlimited number of times as the index pattern 40 around the index piston 30 is a repeating pattern without end. In other embodiments of the invention, the index pattern 40 may have more than one locked-open position 43, such that the different locked-open positions 43 have different heights in the index pattern 40. Locked-open positions 43 of different heights hold the valve 1 open in different degrees so as to make it possible to provide restricted flow through the valve 1 in the reverse-circulation direction.

According to one embodiment of the invention, a casing string 2 is deployed with complete well control while making up the casing string 2 and positioning it into the desired location of the well bore. Once the casing 2 is positioned at its desired location and the top end of the casing is secured with safety valves (cementing head or swage) the back pressure valve 1 may be disabled (without casing/tubing movement) allowing flow from the well bore to enter the string and exit from the top of the string which in return will allow placement of desired fluids into the well bore and around the casing string 2. When the fluid is at the desired location within the well bore the movement of fluid can be stopped by reactivating the back pressure valve 1.

Certain embodiments of the invention include cementing float equipment back pressure valves for reverse cementing applications. These valves involve the use of an indexing mechanism to activate and deactivate the back pressure valve allowing fluid movement from desired directions. The activation process may be manipulated as often as desired during operations of running casing in the hole or the actual cementing operations.

The valve may be activated as follows. First, when the valve 1 is in the normal operation mode (closed position), flow from the outside is checked (see FIG. 1A). The well may be circulated from the inside of casing to outside without deactivation of back pressure valve 1. Increased flow rate creates pressure drop across flow ports 31, thus indexing the valve into the open position (see FIG. 2A). Releasing the flow pressure allows the lug to hold the valve 1 open (see FIG. 3A). Flow from either direction can be achieved at this time (circulation or reverse-circulation) (see FIG. 3A). The valve may be closed again by increased flow rate from the inner diameter to outside of casing/tubing 2. (FIG. 2A) This allows the valve 1 to return to normal operation (no flow allowed from outside to inside). (FIG. 1A) This process can be repeated as often as desired.

The valve 1 allows complete well control while running the casing/tubing 2 in the hole with the ability to circulate the well without manually activating the indexing mechanism. When desired the valve can be locked-open to perform reverse circulation. If or when desired the valve can be activated again to shut off (check) the flow from annuals gaining complete well control again with the ability to release any pressure trapped on the side of the casing/tubing string. The valve can be activated and deactivated as often as desired.

Figure 5A:
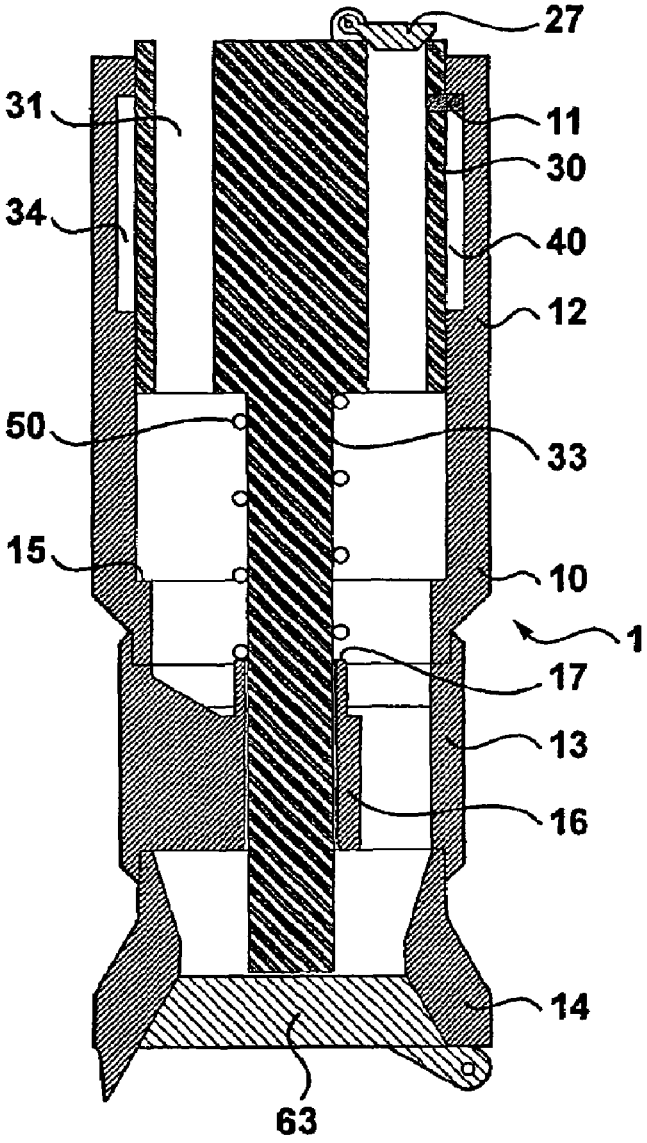
FIG. 5A is a cross-sectional side view of an embodiment of a valve of the present invention, wherein the valve is shown in a closed configuration.
Figure 5B:
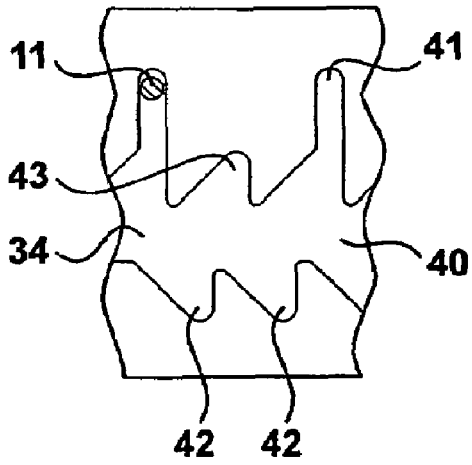
FIG. 5B is a schematic side view of an embodiment of an index pattern and indexing lug, wherein the indexing lug is located in a closed position.
Figure 6A:
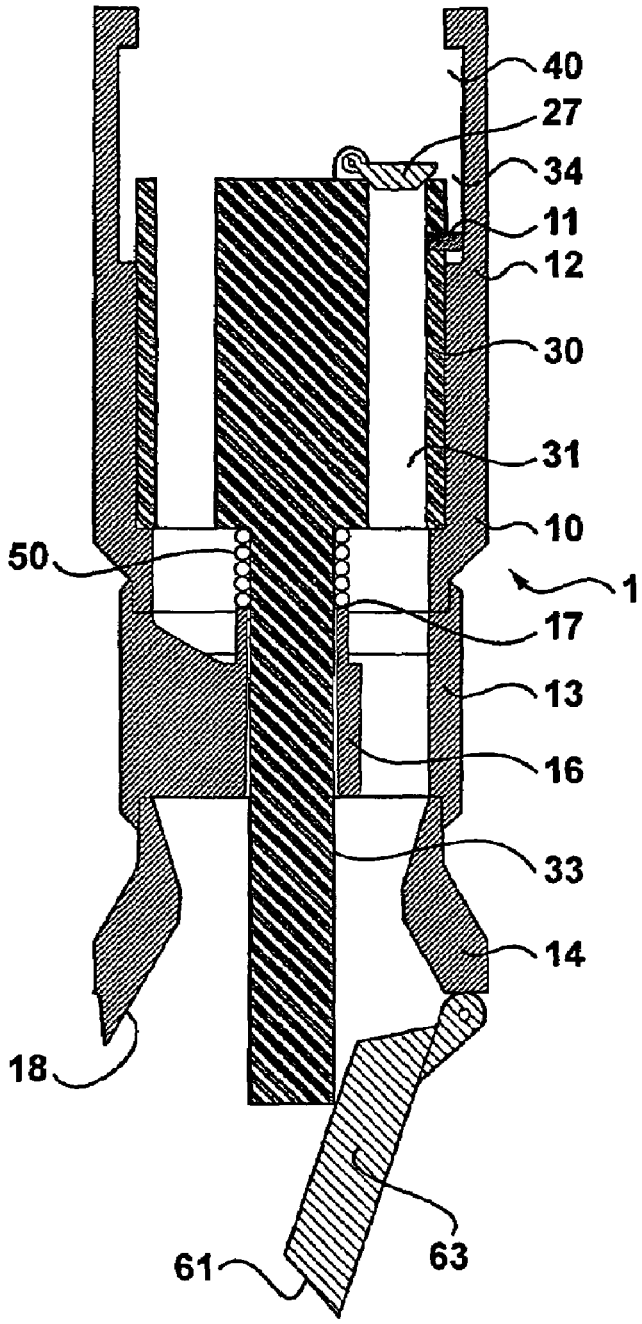
FIG. 6A is a cross-sectional side view of the valve of FIG. 5A, wherein the valve is shown in a flow-open configuration.
Figure 6B:
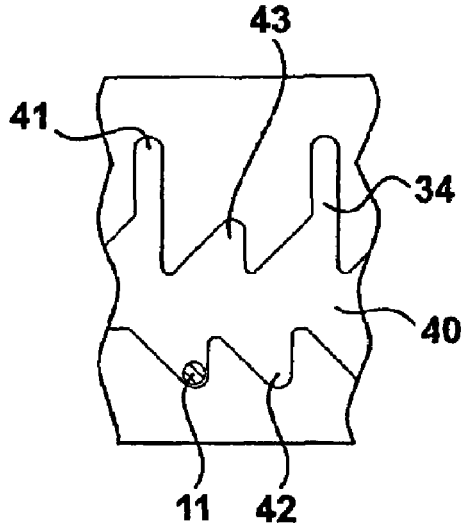
FIG. 6B is a schematic side view of the index pattern and indexing lug of FIG. 5B, wherein the indexing lug is located in a flow-open position.
Figure 7A:
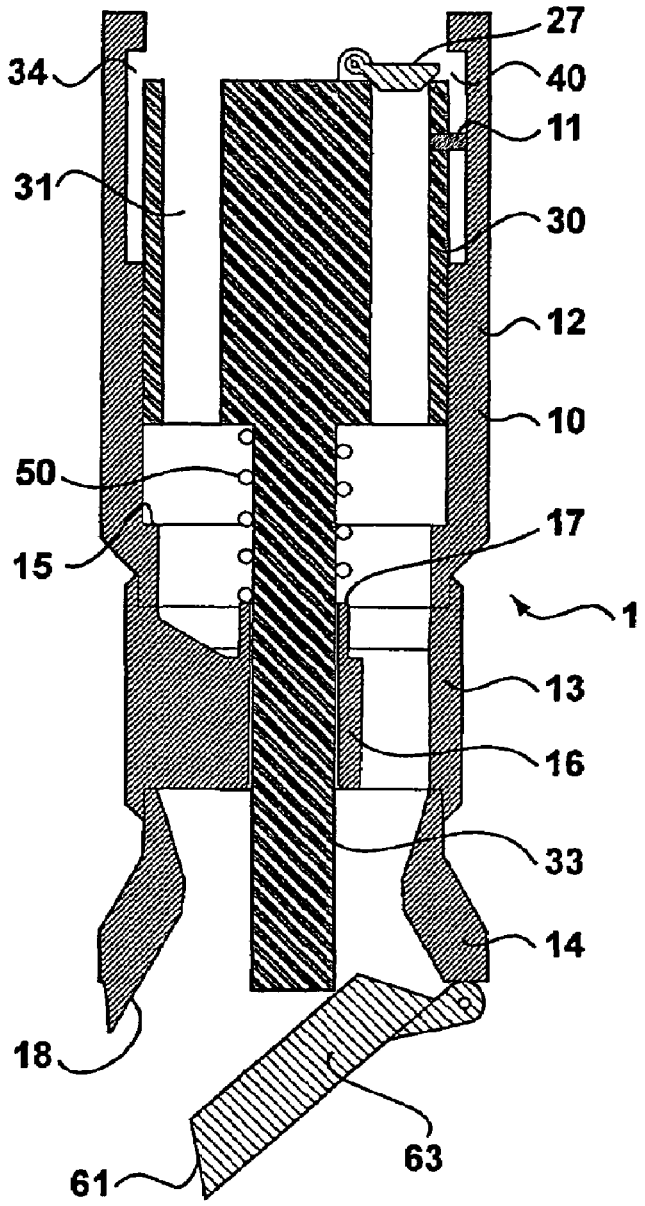
FIG. 7A is a cross-sectional side view of the valve of FIGS. 5A and 6A, wherein the valve is shown in a locked-open configuration.
Figure 7B:
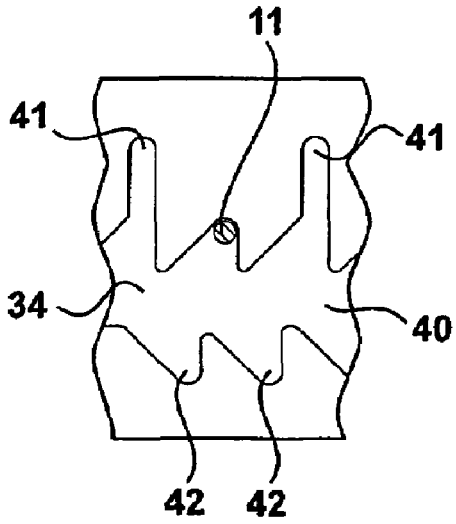
FIG. 7B is a schematic side view of the index pattern and indexing lug of FIGS. 5B and 6B, wherein the indexing lug is located in a locked-open position.

Referring to FIGS. 5A, 6A, and 7A, cross-sectional side views of an alternative valve 1 are illustrated. The valve 1 has several major components including: a valve collar 10, a detent flapper 27, an index piston 30, an index pattern 40, a spring 50, and a flapper plug 63. In FIG. 5A, the valve 1 is shown in a closed position. In FIG. 6A, the valve 1 is shown in a flow-open position. In FIG. 7A, the valve 1 is shown in a locked-open position. FIGS. 5B, 6B, and 7B illustrate schematic side views of the index pattern 40. In each of these figures, an indexing lug 11 is shown in a different position as described more fully below.

Referring to FIGS. 5A, 6A, and 7A, each of the major components of the valve 1 are described. Similar to the previously described embodiment, the valve collar 10 is a cylindrical structure comprising an indexing section 12, a mounting section 13, and a seat section 14. As before, the indexing section 12 has a shoulder 15. The mounting section 13 has a stem mount 16 that extends from the inside diameter side wall of the mounting section 13. The stem mount 16 is an arm having an annular eyelet at its distal end for receiving a stem 33 of the index piston 30. The seat section 14 has a beveled valve seat 18 for receiving the flapper plug 63.

As shown in FIGS. 5A, 6A and 7A, the index piston 30 has a plurality of flow ports 31 that extend through the index piston 30 parallel to the longitudinal central axis of the index piston 30. At least one detent flapper 27 is positioned at the opening of at least one of the flow ports 31. An annular seal 32 is positioned in a recessed near the top of the outside circumference of the index piston 30 to form a seal between the index piston 30 and the valve collar 10. The annular seal 32 restricts fluid flow between the two structures even as the index piston 30 translates longitudinally within the valve collar 10.

In this embodiment of the valve 1, the indexing section 12 of the valve collar also has an indexing J-Slot 34 in its interior wall. The indexing J-Slot 34 has an index pattern 40. The stem 33 extends from the bottom of the index piston 30 through the stem mount 16. As shown in FIGS. 5A, 6A, and 7A, the spring 50 is positioned concentrically around the stem 33 of the index piston 30. At its upper end, the spring engages the lower face of the index piston 30 and at its lower end, the spring 50 engages a spring shoulder 17 at the upper edge of the stem mount 16. In FIG. 5A, the spring 50 is illustrated in a relaxed or expanded position, while in FIG. 6A, the spring 50 is completely compressed. In FIG. 7A, the spring 50 is only partially compressed. The flapper plug 63 is connected to a lower most end of the seat section 14 of the valve collar 10 for pivotal movement into and out of engagement with the valve seat 18 of the seat section 14. The flapper valve seats in the valve seat 18 and is biased to a closed position by a spring as is known in the art. The flapper plug 63 has a conical seal surface 61 for engagement with the valve seat 18. The flapper plug 63 is opened by the stem 33 when the stem extends through to the seat section 14 to push the flapper plug 63 from its biased position in the valve seat 18. When the index piston 30 and stem 33 are driven downwardly relative to the flapper valve, the stem extends through the valve seat 18 to push and hold the flapper valve open. In further embodiments of the invention, the poppet plug 60 or flapper plug 63 are replaced with any valve mechanism known to persons of skill.

Referring to FIGS. 5B, 6B, and 7B, the index pattern 40 defines several lug positions that are used to configure the valve in closed, flow-open, and locked-open positions. Closed positions 41 are located in the upper-most portions of the index pattern 40. When the indexing lug 11 is located in one of the closed positions 41, the valve 1 is configured in a closed configuration. Flow-open positions 42 are found in the lower-most portions of the index pattern 40. As shown in FIG. 6B, when the indexing lug 11 is positioned in one of the flow-open positions 42, the valve 1 is configured in a flow-open configuration. Locked-open positions 43 are found in a medium upper position of the index pattern 40. When the indexing lug 11 is in a locked-open position 43, the valve 1 is in a locked-open configuration. FIG. 7B illustrates the indexing lug 11 in a locked-open position 43 which corresponds to a valve 1 configuration that is locked-open as illustrated in FIG. 7A. FIG. 5B illustrates the indexing lug 11 in a closed position 41, which corresponds to a closed valve 1 configuration as illustrated in FIG. 5A. FIG. 6B illustrates the indexing lug 11 in a flow-open position 42 which corresponds to a valve flow-open configuration as illustrated in FIG. 6A.

In the embodiments of the invention illustrated in FIGS. 5A, 6A, and 7A, one or more flapper valves 27 are seated in the tops of the flow ports 31. To allow restricted flow through the flow ports 31 in the circulation direction, at least one of the flow ports 31 is not equipped with a flapper valve. In still further embodiments of the invention, the ball cage 20 or flapper valves 27 are replaced with any valving system known to persons of skill, wherein the valving system provides restricted fluid flow through the flow ports in the circulation direction, and unrestricted fluid flow through the flow ports 31 in the reverse-circulation direction.

The valve described with reference to FIGS. 5, 6 and 7 is operated in a similar manner as that described for FIGS. 1, 2 and 3.

As described herein the detent in the indexing piston takes on many forms. In FIGS. 1A, 2A, and 3A, the detent is a fewer number of balls 26 than flow ports 31. In alternative embodiments of the invention, the ball cage 20 retains the same number of balls 26 as flow ports 31, but each of the balls has grooves in their exterior surfaces so that when the balls 26 lodge or seat themselves in the openings of the flow ports 31, a relatively smaller amount of fluid passes through the grooves in the balls 26 and into the flow ports 31. In FIGS. 5A, 6A, and 7A, the detent is a fewer number of detent flappers 27 than flow ports 31 in the indexing piston 30. In an alternative embodiment of the invention, the detent has the same number of detent flappers 27 as flow ports 31, but the detent flapper(s) 27 only partially closes the flow port(s) 31 when the detent flapper(s) 27 moves to a closed position. For example, where the flow port(s) 31 has a circular cross-section, the detent flapper(s) 27 has a half-moon cross-section to only partially close the flow port(s) 31.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of regulating fluid circulation through a well casing, the method comprising:

attaching a valve to the casing;

running the valve and casing into the well, wherein the valve is in a closed configuration to maintain relatively higher fluid pressure outside the casing compared to the fluid pressure in the inner diameter of the casing;

circulating fluid down the inner diameter of the casing and through the valve to the outside of the casing, wherein the valve is manipulated by the fluid circulation to an open configuration; and ceasing the circulating fluid, wherein the valve is manipulated to a locked-open configuration;

wherein the circulating fluid down the inner diameter of the casing and through the valve to the outside of the casing comprises flowing the fluid through a detent, wherein an increased relative fluid pressure across the detent manipulates the valve to an open configuration.

2. A method as claimed in claim 1, wherein the attaching comprises cementing the valve to the casing.

3. A method as claimed in claim 1, wherein the running the valve and casing into the well comprises biasing the valve to the closed configuration.

4. A method as claimed in claim 1, wherein ceasing the circulating fluid comprises equalizing a relative fluid pressure across the detent and biasing the valve to a locked-open configuration.

5. A method as claimed in claim 1, further comprising:

recirculating fluid down the inner diameter of the casing and through the valve to the outside of the casing, wherein the valve is manipulated by the fluid recirculation to a flow-open configuration; and ceasing the recirculating fluid, wherein the valve is manipulated to a closed configuration.

* * * * *